United States Patent [19]

Sanders et al.

[11] 4,034,528

[45] July 12, 1977

[54] INSULATING VINYL SIDING

[75] Inventors: Stanley J. Sanders, Roslyn; Vincent Fava, Massapequa, both of N.Y.

[73] Assignee: Aegean Industries, Inc., Roslyn, N.Y.

[21] Appl. No.: 697,416

[22] Filed: June 18, 1976

[51] Int. Cl.[2] ..... E04D 1/34; E04D 1/20; E04D 1/28

[52] U.S. Cl. ..... 52/309.4; 52/311; 52/404; 52/519; 52/527; 52/560

[58] Field of Search ..... 52/309, 311, 312, 404, 52/406, 518, 519, 527, 530, 552, 560

[56] References Cited

U.S. PATENT DOCUMENTS

| | | | |
|---|---|---|---|
| 3,574,109 | 4/1971 | Yoshikawa | 52/309 X |
| 3,605,369 | 9/1971 | Merrill et al. | 52/309 |
| 3,826,054 | 7/1974 | Culpepper | 52/309 |
| 3,887,410 | 6/1975 | Lindner | 52/309 X |
| 3,897,667 | 8/1975 | Turek | 52/309 X |
| 3,961,454 | 6/1976 | Adams | 52/404 |

*Primary Examiner*—J. Karl Bell
*Attorney, Agent, or Firm*—Scully, Scott, Murphy & Presser

[57] ABSTRACT

An insulating vinyl siding adapted to be applied as siding units for home installation and assembled with other similar units. The siding is composed of a preformed thermoplastic polymer facing, a thermal barrier formed by a foam filler, and a metallic foil backing.

10 Claims, 8 Drawing Figures

"A"
"B"
H
h
T
t

INSULATING VINYL SIDING

FIELD OF THE INVENTION

This invention relates to home insulation and, more particularly, to decorative building structures adapted for use as exterior siding, the latter of which is characterized by substantial thermal insulation values.

A. Background of the Invention

The significant increase in home heating expense attendant the "energy crisis" of recent years has sparked interest in methods for enhancing the thermal insulation of building structures, especially single family residences which are often poorly or inadequately insulated as originally constructed.

Various approaches or solutions to insulation problems as currently proposed include the insertion, as by blowing or injection, of insulation material into wall or ceiling crevices and interstices, or the padding of attic flooring substructures, and the like. Most of such options offer only limited and frequently insignificant improvement in the overall level of insulation of the home because of the limited coverage possible, due to the restricted access to these spaces.

It is, accordingly, most desirable to provide a post-construction insulation technique which affords a more general and uniform improvement in building and particularly home insulation. The expense of any such operation is more easily borne when a multifunctional approach can be devised, and this is a special feature of the present invention.

Aluminum and vinyl sidings have become a popular substitute for the periodic or biennial painting of homes because of their ready cleanability and resistance to deterioration. Aluminum siding has become relatively expensive, and is inherently less resilient, hence more difficult to use in construction, thereby enhancing interest in vinyl structures which are also capable of permanent use. Such siding is easily installed around and about doors and windows and constitutes a permanent improvement in building and home value. The vinyl siding itself is of substantial thickness and, although resilient, is of substantial rigidity to satisfactorily hold up under the long term usage to which it is subjected. The conventional structures which are currently in use do not offer significant insulation value.

B. Discussion of the Prior Art

Insulation per se may be offered by foamed or molded structures simulating roofing, siding or the like, as shown in U.S. Pat. Nos. 2,362,236 or 3,899,855, for example, but exterior durability in the absence of painting and flexibility in the introduction of ornamental features is restricted. Voids in the plastic planks of U.S. Pat. No. 3,054,223 afford some insulation, but introduce weaknesses in the resulting structure and formulate potential moisture traps.

U.S. Pat. No. 3,593,479 discloses weather-protective rigid, hollow ornamental wood-simulate siding units of molded plastic material, however, without significant insulation value. Improved insulation characteristics may be afforded, as noted above, by separately supplied insulation, associated in construction as described in U.S. Pat. No. 3,304,676, but it is preferred to provide for the construction site an integral structure for direct application, especially where complex contoured facings are concerned.

U.S. Pat. No. 3,420,024 shows a multilayered structure including insulation of the wood fiber type. In fact, doors, panels and other like sandwich constructions of rigid character employing interposed filler material are of course known, but are to be distinguished from the generally single faced configurations useful for sidings having a degree of conformability adapted to the rough undersurface in home construction to which they will be affixed by nailing or the like. Moreover, in these cases, the structures are of relatively substantial weight, whereas a low density siding panel is preferred for ease of manipulation during application. Also, it is desirable to avoid wood fiber and the like at least semi-flammable materials.

A further approach which has heretofore been taken in this art is to over-coat e.g. polyurethane molded blocks with a latex coating, such as in the nature of a thin protective layer. As with all such coatings, exterior durability is restricted, whereas it is desired to provide a permanent and essentially maintenance-free structure.

SUMMARY OF THE INVENTION

It is accordingly an object of the invention to provide economical means for enhancing the thermal insulation of existing building structures, and particularly personal homes and residences.

It is a further object to provide such enhanced insulation adjunctively with other home improvement means.

A more specific object is the provision of maintenance free decorative facings for buildings and homes having substantial insulation value.

A still further object is the attainment of the foregoing ends in a structure capable of faithfully reproducing natural home building material surface detail and providing complex surface geometry consistently with rigidity and conformability for durability and ease of construction.

Yet another object is to secure such properties in an integral structure of the above-mentioned type which is of light weight and capable of interengagement with like units to thereby form a coherent moisture and thermal barrier.

Finally, it is an object to prepare such a building substructure possessed of fire-retardant character, and with minimum usage of materials undergoing undesirable degradation under fire conditions.

In accordance with the invention, an essentially maintenance-free siding structure for permanent use is provided, which is characterized by a substantial insulation value and offering considerable economies. The individual units, of minimum weight, are readily interengaged in construction and assembly into an integrated exterior covering for homes and the like, by means of interlocking tabs to thereby form a coherent moisture and thermal barrier. The low weight and thermal characteristics of the structure are provided by a relatively low density rigid polyurethane foam filler integrally bonded to an exterior facing layer of plastic cladding which is contoured into the desired ornamental form. The facing layer is of minimal thickness but offers significant exterior strength and durability. The laminar structure is completed, in the preferred embodiment, by an integrally bonded reflective backing layer constituted by metallic foil.

BRIEF DESCRIPTION OF THE DRAWINGS

Reference may now be had to the following detailed description of a preferred embodiment of the invention taken in conjunction with the accompanying drawings; in which.

DETAILED DESCRIPTION OF THE INVENTION

Figures 1, 2, 3, 4, 5, 8:
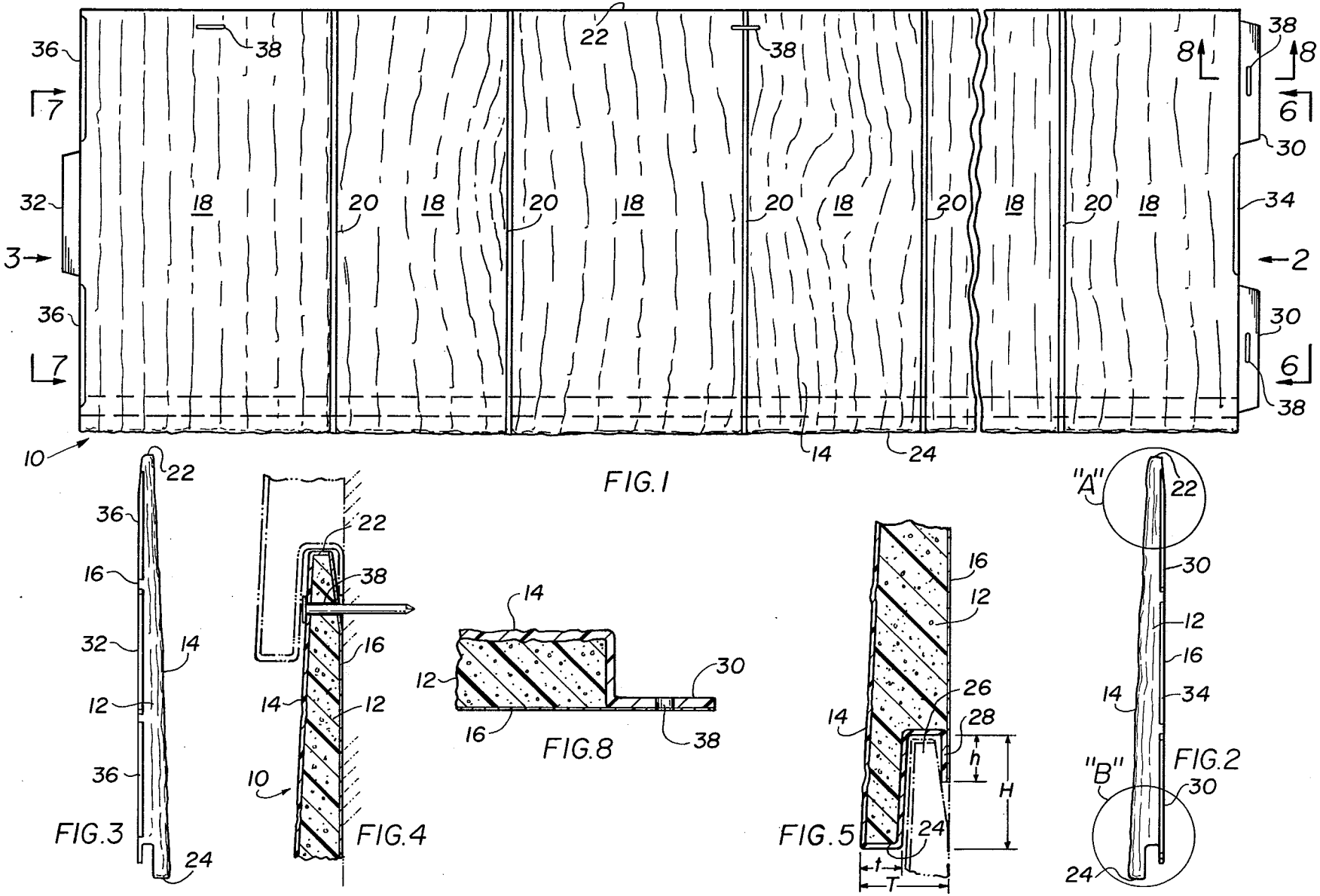
FIG. 1 shows a top plan view of a siding unit constructed in conformance with the present invention.
FIG. 2 is an end view of the siding unit of FIG. 1 taken in the direction of arrow 2.
FIG. 3 is an end view of the siding unit of FIG. 1 taken in the direction of arrow 3.
FIG. 4 is an enlarged fragmentary section of encircled detail A in FIG. 2.
FIG. 5 is an enlarged fragmentary section of encircled detail B in FIG. 2.
FIG. 8 is an enlarged section taken along line 8—8 in FIG. 1.

The siding structure 10 of the invention may be more readily visualized by reference to the accompanying drawings, and particularly FIGS. 1 to 3, illustrating a thermal barrier 12 constituted of a low density filler, a preformed facing layer 14 composed of a polymer cladding, and a reflective backing layer 16 of a metallic foil. In this embodiment, the facing layer 14 of the siding structure 10 is contoured and textured into parallel courses of cedar shake shingle design. Preferably, although not necessarily, the thermal barrier 12, facing layer 14 and backing foil 16 are integrally bonded to each other. As shown in FIG. 1 of the drawings, the exterior surface of the facing layer 14 provides for a design indicative of a plurality of adjacently spaced shingles 18 of random widths which are separated by substantially parallel and randomly spaced grooves indentations 20 formed in the facing layer 14.

As illustrated in the encircled detailed portions A and B in FIG. 2 of the drawings, the siding structure 10, which is preferably of generally rectangular configuration, includes an upper longitudinal edge portion 22, as shown on an enlarged scale in FIG. 4, and a lower longitudinal edge portion 24, as shown on an enlarged scale in FIG. 5, and which are adapted to form so-called "tongue-and-groove" connections with other siding structures located respectively above and/or below siding structure 10 and in interengagement therewith. As is common with siding structures simulating cedar shake shingle, the upper end has a generally thinner cross-section than the lower end. In the present inventive construction, the upper end 22, as shown in FIG. 4, has its foil-covered rear surface tapered upwardly and forwardly to provide a somewhat narrower construction in cross-section at its apex.

Referring to FIG. 5 of the drawings, the lower end 24 of the siding structure 10 is provided with a longitudinal groove extending therealong and oriented towards the rear of the siding structure. The groove has a height H, and is defined in transverse section by a portion of the facing layer 14 being molded or conformed into the particular illustrated S-shaped configuration. The lower front extremity of edge portion 24 has a thickness $t$ whereas the entire or overall cross-sectional thickness of the siding structure 10 along the lower end thereof has a thickness or width T. Thus, in effect, the longitudinally extending groove has a cross-sectional dimension of $H \times (T-t)$. A downwardly depending lip or flange 28 is formed in the plane of the rear of the siding structure by the vinyl material constituting the facing layer 14, and has a height $h$.

Figure 6:
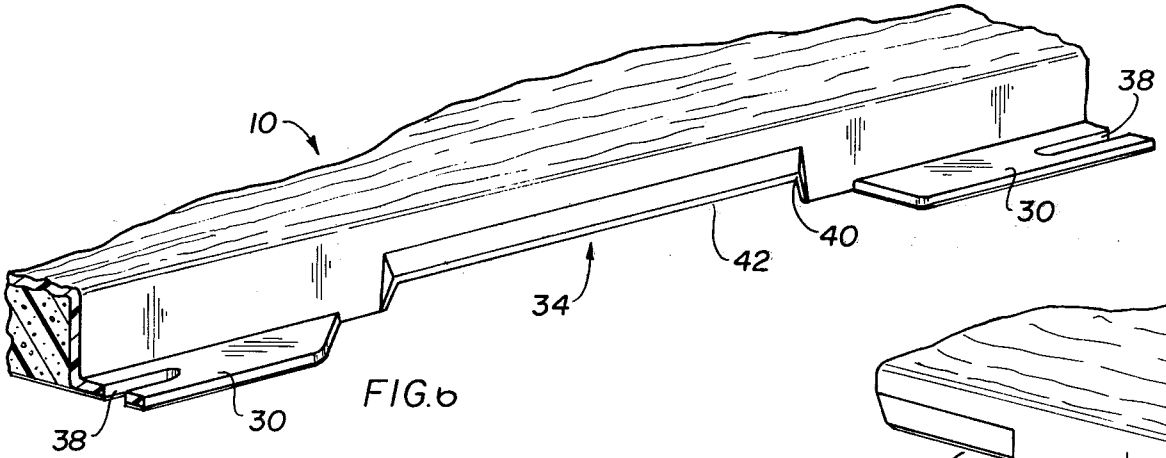
FIG. 6 illustrates an enlarged perspective detail of the siding unit viewed in the direction of arrows 6—6 in FIG. 1.

The oppositely sided or right and left hand end edges of the siding structure 10 each comprise alternating flanges and recesses for providing engagement with adjacent or contiguous siding structures which are located on either side and in assembled relationship therewith. Thus, referring in greater particularity to FIGS. 1 and 2 of the drawings, the illustrated right-hand edge of the siding structure 10 includes laterally extending flanges 30 projecting from the structure proximate the upper and the lower edges 22 and 24 thereof in coplanar relationship with the rear surface of the siding structure. These flanges, as shown in FIG. 8 of the drawings, are constituted of projections integrally formed with the facing layer 14. Intermediate the flanges 30, as more clearly illustrated in the perspective view of FIG. 6, there is provided a cut-out or recess 34 which is inclined back from the vertical surface formed between the front of facing layer 14 and the flanges 30, as shown by reference numeral 40, and with the rear portion of the siding structure 10 incorporating an aperture 42 formulated by removal of the filler or thermal barrier 12 from that region of the siding structure, and adapted to be employed as described more fully herein-below.

Figure 7:
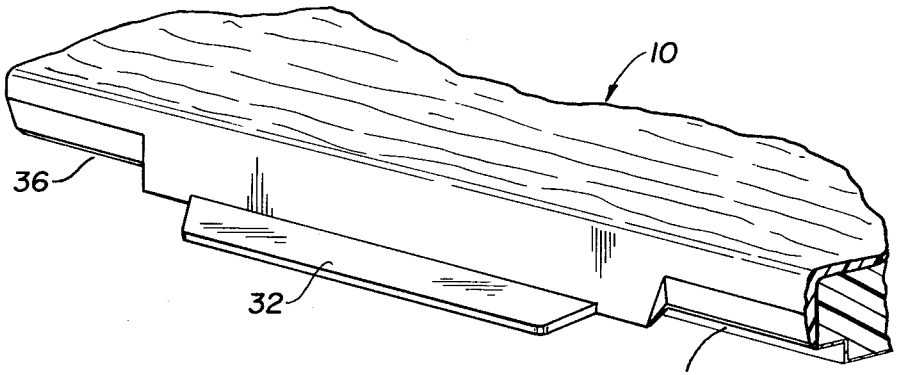
FIG. 7 illustrates an enlarged perspective detail of the siding unit in the direction of arrows 7—7 in FIG. 1.

In a somewhat similar arrangement referring now to the left-hand edge of the siding structure 10 as shown in FIGS. 1, 3 and 7 of the drawings, there is provided a centrally located flange 32 intermediate edges 22 and 24 which is in coplanar relationship with the flanges 30 at the opposite end of the structure and with recesses 36 being formed on either side of flange 32 in a manner and configuration analogous to the recess 34 intermediate flanges 30. The principal distinction between the constructions of the right-hand edge and the left-edge of the siding structure 10 lies in that the former is provided with one centrally located recess 34 positioned intermediate two flanges 30, whereas the latter includes two recesses 36 positioned on either side of a centrally located flange 32. Thus, when two or more siding structures are positioned in an end-to-end assembled relationship, the central flange 32 at the left hand edge of one siding structure will be in aligned engagement with the recess 34 between the two flanges 30 located at the right-hand edge of the adjacent siding structure. Appropriate spacing between adjacently assembled siding structures 10 may be provided for by incorporating suitable nubs or small projections thereon to thereby formulate a simulated cedar shake shingle groove between adjoining siding structures.

In order to facilitate the fastening of the siding structure 10 or structures to a base member or surface located on the building, appropriately spaced nail slots 38 may be formed in the siding structure and preferably arranged proximate the upper edge 22 and through flanges 30. Thus, in the assembling of a plurality of vertically superimposed siding structures, initially the lowermost siding structure 10 is nailed to the base member or building surface by driving fastening nails through the respective slots 38 along the upper edge 22 and flanges 30. As may be ascertained from FIG. 5 of the drawings, the nail slots 38 which are provided proximate the upper edges 22 are spaced from the edge by a distance somewhat greater than the height $h$ of the flange 28. This will then permit another siding structure to be superimposed above the first siding structure 10 in an overlapping or dovetailed relationship so that the lower edge 24 has its rear surface projecting over the front surface of the facing layer 14 of the lower siding structure, and with the flange 28 of the upper structure sliding behind the upper end of the forwardly sloped or tapered rear surface of the lower siding structure until the upper edge 22 contacts the bottom of the groove of the superposed siding structure. This will preclude and fastening nails from being exposed after assembly of the siding structures.

Similarly, the assembling of sidewise adjacently located or contiguous siding structures 10 will prevent an overlapping thereof so that the rear surface of an adjacent siding structure will cover the nails which have been hammered through the slots 38 in flanges 30, thereby avoiding any exposure of the thermal barrier 12 or backing foil 16. This, in effect, will provide for excellent insulating properties in conjunction with a finished product look while eliminating any external porosities allowing the elements to adversely affect the siding structures.

The plastic cladding constituting the exterior facing may be prepared from any thermoplastic organic polymeric material, including polyolefins or polyvinyls, polycarbonates, polyacetals, polysulfones, polyesters, polyamides and the like, or mixtures thereof. The most desirable material on a cost/performance basis is polyvinyl chloride. The polymer may be and preferably is formulated to comprise coloration agents, ultraviolet stabilizers or fire retardants, as well-known in the art. Where desired, the cladding may be strengthened or stiffened by the inclusion of glass fiber, for example. Unlike vinyl emulsion coatings of essentially paint-like character, the cladding acts as a permanently decorative U.V. and moisture seal.

The thermoforming operation may be effected by any known means but for larger dimensioned pieces vacuum forming will prove most convenient. For example, a 2 × 3 foot sheet comprising two adjacent courses of cedar shake simulate, or a 1 × 6 foot sheet in a single course having a depth ranging from ¾ to ⅜ inch, may be readily formed into a 25 – 45 mil cladding by this method.

Although any insulating low density foam may be employed as the filler, most preferably a fire retardant grade of polyurethane foam is employed, having a cured density of about 2.0 to 3.5, preferably 2.0 to 2.5 lb/ft$^2$. For the aforementioned sheet, an amount of about 1 lb. of foam is sufficient to provide an insulation equivalent to conventional fiberglass insulation employed in homes.

The filler may be poured directly into the preformed exterior face sheet and cured therein in conventional manner, and 1 mil to 3 mil thick aluminum foil backing applied thereover to complete the laminar structure. Such a procedure insures that the foam filler will conform to the geometry of the facing and be uniformly bonded thereto across the whole of the structure.

The preforming of the vinyl cladding is important to ensure faithful reproduction of the complex decorative geometry and surface detail imposed in the molding process. The direction application of the foam filler in the uncured state insures that the filler directly bonds to the cladding providing an integral structure face to face without significant hollows, for improved structural rigidity, having regard for the thin exterior cladding, and minimization of moisture traps. For the same reason, the aluminum foil is preferably applied to the polyurethane in the at least partially uncured state.

The cross-sectional design of the facing and hence the siding unit will vary with the conformation of the decorative face. Thus, in the case of cedar shake simulate in two adjacent courses, the cross section will comprise two generally wedge shaped sections juxtaposed in the same sequence, with the leading edge uppermost. The wedge ramp and, to some extent the wedge elevation will be irregular in shape as a result of the wood grain and texture being simulated, in the outer surface of the siding.

The plastic cladding does not terminate in the front face, but at least partially wraps around, forming integral edges out of the plane of the face. Interlocking means are provided in the side edges for interengagement with other like units.

In the preferred embodiment depicted, the upper and lower edges comprise a matching tongue and groove, respectively. The configuration preferably extends across the whole of each edge and is molded into place in both of the plastic cladding and the polyurethane foam. Thus, the rigidity of the foam lends strength to the junction point, while the plastic cladding covering the edge and the tongue and groove portion, provides surface lubricity for ready interengagement, and an enhanced moisture seal.

Similarly, the side edges are formed with integral tabs extending along the whole of the edge adapted for mating and locking engagement with coordinate tabs in an adjacent unit. Preferably, the tabs comprise a horizontal extension of the rigid foam structure having a depth of about one half of the full edge, on one side elevated from the front or outer surface of the unit, and on the other side elevated from the rear face of the unit, such that the tabs slip together and across each other in facial engagement. Again, the plastic cladding covers the tabs with the same attendant advantages. Locking engagement is provided by a male and female numb and hollow formed in the respective tab surfaces to juxtapose in the fully butted placement of the adjacent units. This arrangement may be continuous or discontinuous along the side edge, but is preferably continuous for the best seal. In each case, the interengagement means may in the course of construction be coated with an external sealant or lubricant if desired.

Also formed in the tongue and groove portions, where desired, are holes or oblong apertures keyed to form a common axial entry between units, for the insertion of construction fasteners e.g. common nails. The provision of such apertures insures that the units are emplaced in proper vertical alignment during construction. It will be understood, of course, that adjacent courses of the siding units may be desirably stepped i.e. horizontally displaced relative to the upper and lower juxtaposed such units so that the vertical interconnections between units in a given course are not vertically aligned with those of adjacent units. Additional apertures may accordingly by provided at other locations along the tongue and groove to accomodate this alignment.

Reference is made herein to a plastic 'cladding' borrowing a term from the metal bonding arts, to connote the relatively thin layer contemplated and the intimate bonding effected with the adjacent foam filler.

The siding structures referred to herein as a matter of convenience of course contemplate other surface coverings of like kind and nature, whether for roofing or even interior walls, if otherwise appropriate. The decorative aspects of the cladding layer may therefore be limited principally as a matter of taste, but most typically will approximate in surface detail wood grains and textures, as represented by cedar shake shingles. In the most preferred embodiment, the clapboard or shingle simulates commonly may include in an individual unit more than one e.g. two courses, and the laps may be separated conceptually into one or more shingles for example, along the length. The minimal weight of the instant structures permits individual units to be easily handled at dimension of 2 × 3 feet or greater.

What we claim is:

1. An elongate generally planar laminar construction adapted to be nailed to a subsurface for use as a siding unit for home installation, said unit having substantial insulation value, said construction comprising a continuous decorative self-supporting outer facing layer composed of a thermoplastic polymer, said facing layer exhibiting a detailed surface geometry; said facing layer having extended top and bottom edges to form, respectively, a cooperating and mating tongue-and-groove arrangement, for interengagement with other such siding units; an inert at least semi-rigid foam filler as an internal thermal barrier, and a metallic foil backing layer being directly bonded to said filler to provide an integral coherent structure; the rear surface of the top edge portion of said siding unit being tapered forwardly to thereby form a gap between said siding unit and said subsurface to which said structure is fastened, the bottom edge of said siding unit having a depending flange portion whereby the depending flange portion of an upper disposed siding unit is adapted to be seated in the gap formed between the top edge of a lower disposed siding unit and the subsurface to thereby provide a rigid connection between said siding units, said unit providing per square foot an insulation value equivalent to at least standard fiberglass insulation.

2. The laminar construction of claim 1, wherein said foam filler is a polyurethane.

3. The laminar construction of claim 2, wherein said thermoplastic polymer is polyvinyl chloride.

4. The laminar construction of claim 3, wherein said metallic foil comprises an aluminum foil of about 1 to 3 mil thickness.

5. The laminar construction of claim 1, wherein said facing layer is formed into the shape of clapboard.

6. The laminar construction of claim 1, wherein said facing layer is formed into the shape of cedar shake shingles.

7. The laminar construction of claim 1, wherein said facing layer extends beyond the face to form integral sides.

8. The laminar construction of claim 1, wherein the opposite side edges are extended, respectively, to form cooperating and mating tabs bearing a nub and hollow arrangement for locking engagement with other such units.

9. The laminar construction of claim 1, said facing layer having a thickness of about 25 to 45 mils, and said filler having a density of less than about 3.5 lbs/ft$^2$.

10. A method for the conversion of an under-insulated home, comprising applying uniformly to the outer walls a multiplicity of the units of claim 8 interengaged to form a coherent moisture and thermal barrier thereon.

* * * * *